US005876263A

United States Patent [19]

DeCesare et al.

[11] Patent Number: 5,876,263

[45] Date of Patent: Mar. 2, 1999

[54] TOY ANIMAL WITH MOVING TONGUE

[75] Inventors: John J. DeCesare, Glen Ridge; Thomas J. Flaherty, Highlands, both of N.J.

[73] Assignee: DeCesare & Flaherty Associates LLC

[21] Appl. No.: 978,728

[22] Filed: Nov. 26, 1997

Related U.S. Application Data

[60] Provisional application No. 60/059,433, Sep. 22, 1997.

[51] Int. Cl.[6] ..... A63H 3/20

[52] U.S. Cl. ..... 446/330; 446/338

[58] Field of Search ..... 434/401; 446/103, 446/304, 308, 309, 320, 330, 337, 338, 340, 341, 346, 352, 353, 355, 356, 373, 391, 395

[56] References Cited

U.S. PATENT DOCUMENTS

| | | | |
|---|---|---|---|
| 1,486,101 | 3/1924 | Megorden . | |
| 2,798,334 | 7/1957 | Plachter . | |
| 3,099,894 | 8/1963 | Carroll | 446/341 |
| 3,236,006 | 2/1966 | Carroll | 446/341 |
| 3,828,469 | 8/1974 | Giroud . | |
| 4,224,759 | 9/1980 | Saint-Pierre et al. . | |
| 4,304,063 | 12/1981 | Katzman et al. . | |
| 4,613,315 | 9/1986 | Kataoka | 446/335 |
| 4,662,856 | 5/1987 | Getgey et al. . | |
| 4,669,997 | 6/1987 | Kulesza et al. . | |
| 4,689,033 | 8/1987 | Droller et al. . | |
| 4,778,433 | 10/1988 | McKay et al. . | |
| 4,820,236 | 4/1989 | Berliner et al. . | |
| 5,141,464 | 8/1992 | Stern | 446/338 |
| 5,181,877 | 1/1993 | Perkitny | 446/337 |
| 5,304,087 | 4/1994 | Terzian et al. . | |

*Primary Examiner*—Kien T. Nguyen
*Assistant Examiner*—Bena B. Miller
*Attorney, Agent, or Firm*—Anthony J. Casella; Gerald E. Hespos; Ludomir A. Budzyn

[57] ABSTRACT

A toy animal is provided with an electrically powered motor which drives a curled tongue through a generally orbital motion that realistically resembles a licking motion. A switch for actuating the motor may be pressure responsive and may be disposed at a location on the body and/or the head of the animal that may be petted or squeezed. The toy animal may further include a sound chip for generating an appropriate noise when the switch is actuated. Portions of the head near the tongue are formed from a soft deformable material to achieve facial movement simultaneously with the licking motion.

17 Claims, 4 Drawing Sheets

TOY ANIMAL WITH MOVING TONGUE

This application claims the benefit of U.S. provisional application Ser. No. 60/059,433 filed on Sep. 22, 1997.

BACKGROUND OF THE INVENTION

1. Field of the Invention.

The subject invention relates to a toy animal having a tongue that moves in a manner resembling the licking motion of a real animal.

2. Description of the Prior Art.

The prior art is replete with toy animals having one or more parts that can move relative to other parts. Some such prior art toy animals include an actuator remote from the moving part and a plurality of gears and levers connecting the actuator to the moving part. Thus, forces generated at one location on the toy animal will generate movement at another location. In some prior art toys, the actuator is manually driven. For example, U.S. Pat. No. 2,798,334 is directed to a toy animal having a lower jaw that is movable relative to remaining portions of the animal. A lever in the toy is mounted to a peripheral location of an eccentric cam. A string extends from a rear portion of the toy animal and is connected to the cam. Thus, pulling forces on the string rotate the cam and move the lower jaw of the toy animal.

U.S. Pat. No. 4,224,759 shows a toy dog with wheels on a lower surface. The dog can be pulled or pushed along a horizontal surface. Gears are mounted to the wheels and extend to the tail and the tongue of the toy dog. The gears are disposed and dimensioned to generate a wagging of the tail and movement of the tongue as the toy dog rolls along a horizontal surface.

U.S. Pat. No. 4,689,033 shows a toy creature having a tongue that will project rapidly in response to pneumatic pressure generated by squeezing a portion of the toy creature remote from the tongue.

Some prior art toys include internally disposed motors connected to movable parts of the toy by a plurality of gears and levers. For example, U.S. Pat. No. 5,141,464 shows an animated toy having an electric motor and a plurality of gears, levers and springs for generating movement of the head and movement of the tongue within the head. The motor is actuated by a switch located near the back of the toy. Thus, the patting of the toy dog's back will generate movement of the head and a linear projection of the tongue from the head for simulating a licking action.

U.S. Pat. No. 5,181,877 shows a toy dog having a motor mounted in the head of the dog. The motor is connected to a plurality of gears, one of which is near the front of the dog's mouth. A tongue-like projection is mounted eccentrically on this forward most gear and projects through a slot in the dog's mouth. Rotation of the gear causes the tongue to alternately extend from and retract into the dog's mouth while simultaneously causing the tongue to pivot. Thus, the tongue will move in and out and pivot substantially simultaneously.

The prior art also has included a variety of toys having noise generating sources. Some prior art noise generators have been responsive to the rotational orientation of the toy. Others have been responsive to pressure at selected locations on the toy, while still others have included an electrically powered apparatus capable of playing at least one prerecorded noise or expression.

The prior art toys have amused children for many years. However, it is desirable to provide a toy that more accurately reproduces the licking action of a pet animal. For example, an actual licking by a dog is considerably more complex than the mere linear in and out movement of a tongue or the mere up and down wagging of a tongue. Additionally, a licking by a dog is accompanied by other more complex facial movements, particularly in the area of the snout of the dog.

It is another object of the subject invention to provide a toy capable of producing both a licking action and a noise, such as a barking noise for a dog.

It is a further object of the subject invention to provide a toy that will produce a realistic licking action and/or a noise in response to a squeezing or hugging of the toy.

It is an additional object of the subject invention to provide a toy that will produce a realistic licking action simultaneously with realistic facial movements of the toy.

SUMMARY OF THE INVENTION

The subject invention is directed to a toy animal, such as a dog or a cat. The toy animal may include a soft exterior at least portions of which may resemble fur. Interior portions of the toy animal may be at least partly hollow, and may define at least one cavity for receiving operable portions of the toy animal as explained herein.

The toy animal includes a head having a soft snout capable of moving and/or changing shape. The soft exterior fur-like material on the snout is not so tight as to restrict movement of the soft snout. Additionally, the soft exterior fur-like material on the snout may include a seam. At least a portion of the seam may extend along a region that would correspond to a mouth opening on a real animal. A central portion of the seam on the soft snout may be separated or opened. The soft exterior of the toy animal may further include a sock-like tongue exterior that is secured to the fur-like exterior at regions in proximity to the opening in the seam. Thus, the sock-like tongue exterior closes the opening in the fur-like exterior portions of the soft snout and defines a tongue-like projection from the mouth region on the head of the toy animal. The tongue exterior is formed from a soft smooth material, such as velour, and preferably is a red or pink color resembling an actual tongue of an animal.

A flexible interior tongue support has an outer end disposed in the sock-like tongue exterior and an inner end disposed within the soft snout. A tongue lever is mounted in the head of the toy animal and includes a front end mounted interiorly in the soft snout and generally aligned sock-like tongue exterior that projects from the mouth. The tongue lever further includes a rear end in the head and remote from the mouth. The front end of the tongue lever may be mounted to the inner end of the interior tongue support. More particularly, the rear end of the interior tongue support may be folded upwardly and secured to opposite vertically aligned sides of the tongue lever. This attachment of the interior tongue support to the tongue lever provides the flexible tongue with a slight resistance to bending or sagging while still retaining the flexible characteristics of the tongue. Additionally, this mounting of the interior tongue support to the tongue lever provides a non-planar shape for the tongue that more nearly resembles a symmetrical curl that may exist in an actual tongue.

The toy animal further includes a drive mechanism, at least a portion of which preferably is mounted in the head. The drive mechanism may include an electric motor having a main gear. The main gear may be interengaged with a first drive gear which in turn may be interengaged with a second drive gear. The first and second drive gears operatively engage with the tongue lever in a manner that will move the tongue lever in alternating forward and rearward directions, while simultaneously moving the tongue lever in directions transverse to the longitudinal axis of the tongue lever. This combined transverse and axial movement of the tongue lever closely simulates an actual licking movement of the tongue. The movement of the tongue lever also generates movement and shape changing of the snout on the dog simultaneously with the movement of the tongue. Thus, the snout of the toy animal may sequentially move or wrinkle upwardly and then downwardly simultaneously with the respective upward and downward phases of the licking motion to provide both a cute and realistic movement of the face of the toy animal.

In a preferred embodiment, as explained and illustrated below, the interconnection between the motor and the tongue includes a main gear projecting from the motor for movement about the longitudinal axis of the main gear. A first circular drive gear has circumferentially disposed teeth engaged with the main gear, and is rotatably mounted in the head such that rotation of the main gear about its longitudinal axis causes the first circular drive gear to rotate about its axis. A second circular drive gear is rotatably mounted inside the head of the toy animal, and has its circumferentialty disposed teeth engaged with the teeth of the first circular drive gear. The first and second circular drive gears may have eccentrically disposed connections to the tongue lever. For example, the tongue lever may include a longitudinal slot, and one of the circular drive gears may include an eccentrically disposed pin or an offset beater arm slidably and rotatably engaged in the slot. The other circular drive gear may have an eccentrically disposed pivot or offset beater arm connection to a location on the tongue lever spaced from the slot therein.

In operation, the main gear rotates the first circular drive gear which in turn rotates the second circular drive gear. The combined rotational movements of the circular drive gears combined with the pivotal and/or sliding connections between the circular drive gears and the tongue lever to generate a movement of the tongue that closely resembles an actual licking movement. The licking movement, as described in greater detail below, can be varied by altering the relative sizes of at least one of the circular drive gears and the relative angular orientations of the eccentric pins on the circular gears. In most embodiments, however, the tongue will move outwardly and upwardly followed by a downward and inward movement closely resembling an actual licking movement of the pet animal. Additionally, as noted above, this realistic licking movement of the tongue is accompanied by a realistic facial movement of the toy animals particularly in the region of the soft snout.

The toy animal may further include a sound chip capable of reproducing sounds, such as a barking sound. Additionally an actuator switch may be provided for generating driving movement of the motor and/or sound.

DETAILED DESCRIPTION OF THE PREFERRED EMBODIMENT

Figure 1:
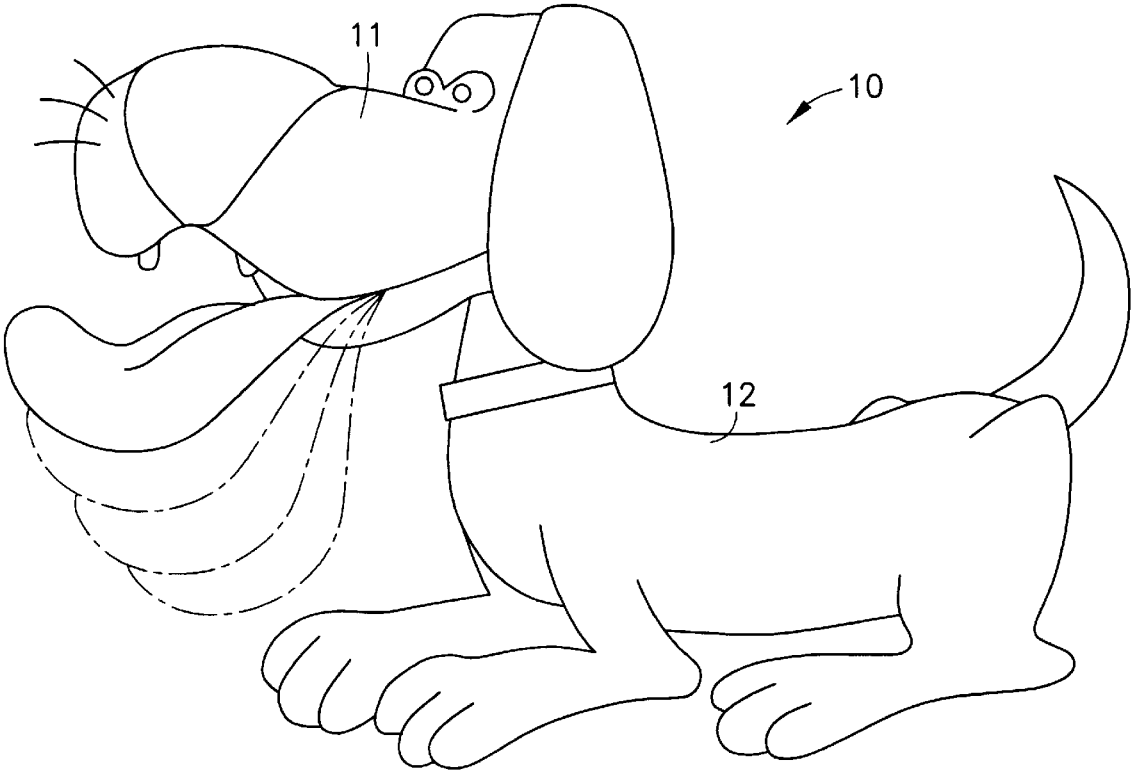
FIG. 1 is a perspective view of a toy animal in accordance with the subject invention.

The toy animal in accordance with the subject invention is identified generally by the numeral 10 in FIG. 1. The toy animal 10 includes a head 11 and a body 12. In the embodiments shown herein, the drive mechanism is disposed entirely within the head. However, in the embodiments shown in FIGS. 1 and 2, at least a portion of the electrical controls, including a battery and an activation switch, are disposed in the body 12. Thus, the head 11 can be securely and permanently closed by the manufacturer. The battery compartment, however, can be accessible for changing batteries as needed. The activation switch preferably is a pressure sensitive activation switch that will respond to the petting or squeezing of the toy animal 10. In the embodiment shown in FIG. 1, the activation switch is disposed in the body 12. In other embodiments, however, the activation switch or an additional activation switch may be disposed in the head 11. Additionally, other electrical components, such as a sound chip and a speaker, may be disposed in either the head or the body.

Figure 2:
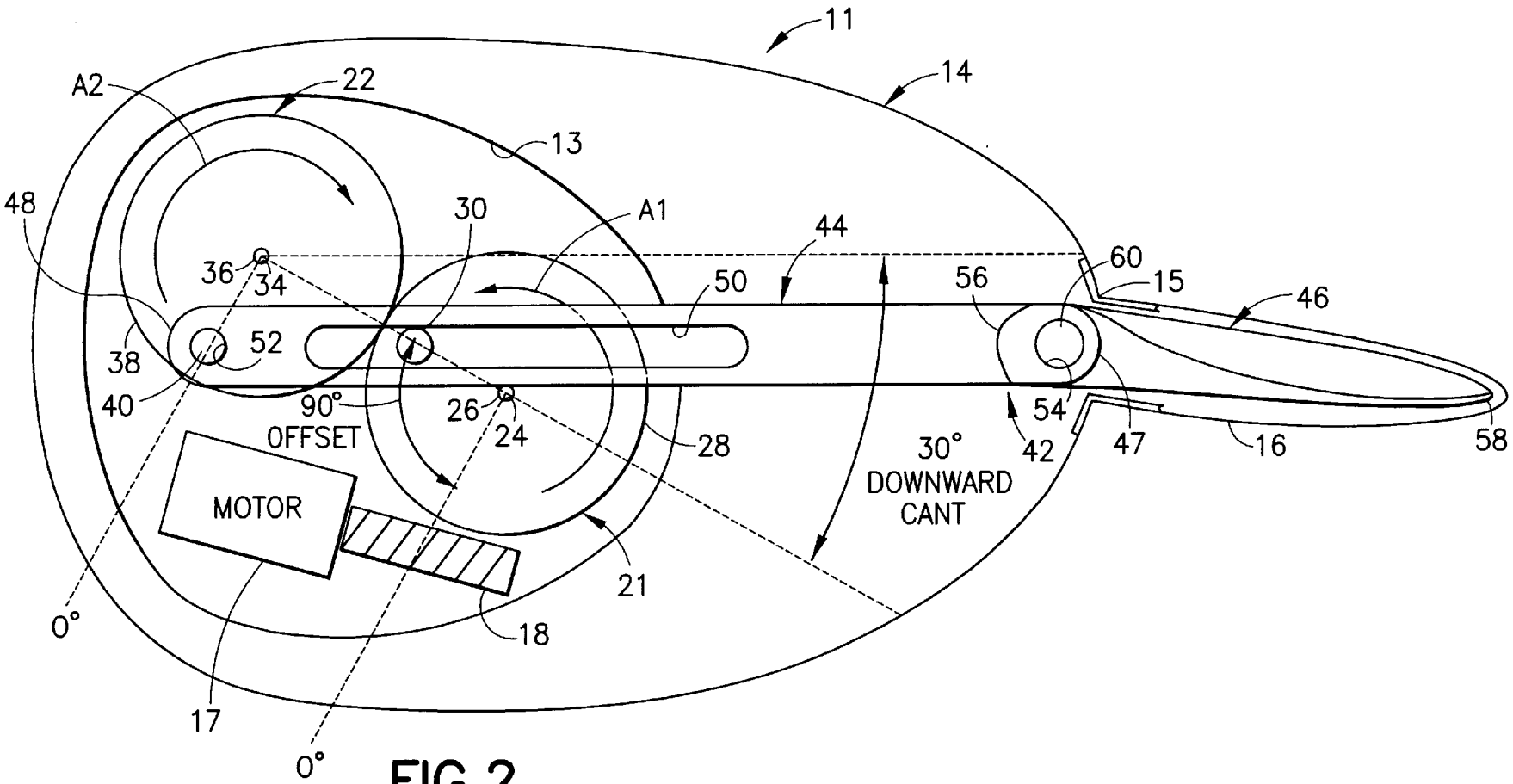
FIG. 2 is a cross-sectional view of the head of the toy animal shown in FIG. 1.

With reference to FIG. 2, the head 11 of the toy animal 10 includes a cavity 13 for accommodating movable parts of the toy. The head 11 also includes fur 14 having a mouth opening 15 that communicates with the cavity 13. Portions of the head 11 near the mouth opening 15 are soft and deformable in response to internal or external forces. A sock-like tongue exterior 16 is sewn or otherwise attached to portions of the fur 14 surrounding the mouth opening. The tongue exterior 16 is formed from a soft smooth material, such as velour.

The toy 10 is provided with a motor 17 securely mounted in the cavity 13 of the head 11. The motor 17 includes a plurality of wires that extend to the battery compartment in the body 12 of the toy animal 10 for appropriate electrical connection to batteries that are removably placed in the battery compartment. The motor 17 is operative to drive the worm gear 18 having an array of helical threads thereon.

The cavity 13 in the head 11 of the toy 10 further includes first and second circular drive gears 21 and 22 respectively. The first circular drive gear 21 includes a centrally disposed aperture 24 that is mounted to a pin 26 in the cavity 13. The first circular drive gear 21 further includes a circumferential array of gear teeth 28 that are engaged with and driven by the worm gear 18. Additionally, the first circular drive gear 21 includes an eccentrically disposed drive pin 30.

The second circular drive gear 22 includes a central aperture 34 rotatably mounted on a pin 36. Additionally, the second circular gear 22 includes a circumferential array of gear teeth 38 that are interengaged with and driven by the teeth 28 on the first circular gear 21. The second circular gear 22 further includes an eccentrically disposed drive pin 40.

The head 11 of the toy 10 further includes a tongue assembly 42. The tongue assembly 42 includes an elongate tongue lever 44 and an interior tongue support 46. The tongue lever 44 includes opposed front and rear ends 47 and 48. An elongate slot 50 is defined in the tongue lever 44 at a location intermediate the opposed front and rear ends 46 and 48 respectively. The slot 50 receives the eccentric drive pin 30 of the first circular drive gear 21. The tongue lever 44 further includes an aperture 52 at a location near the rear end 48 thereof. The aperture 52 rotatably receives the eccentric drive pin 40 of the second circular drive gear 22. The front end 47 of the tongue lever 44 is provided with an aperture 54 for receiving the interior tongue support 46 as explained herein.

The interior tongue support 46 is formed from a soft flexible material such as a rubber sheet. The interior tongue support 46 includes an inner end 56 and an opposed outer end 58. The inner end 56 of the interior tongue support 46 includes attachment structures 60. Thus, the inner end 56 of the interior tongue support 46 can be folded upwardly and around the aperture 54 in the front end 47 of the tongue lever 42. The attachment structures 60 then are secured to one another at the aperture 54 in the front end 47 of the tongue lever 44. This orientation of the interior tongue support 46 provides a small amount of rigidity and support to the flexible material of the interior tongue support 46. The outer end 58 of the interior tongue support 46 is inserted into the sock-like tongue exterior 16. Thus, the tongue will be resiliently deflectable in response to forces exerted thereon.

The motor 17 in the head 11 of the toy 10 is activated by pressing or squeezing a portion of the toy animal 10 near the activation switch which, in the embodiment of FIGS. 1 and 2 is disposed on the body 12. This activation will direct electrical current to the motor 17 and will cause the worm gear 18 to rotate about its axis. Rotational of the worm gear will cause a corresponding rotation of the first circular gear 21 in the direction indicated by the arrow Al in FIG. 2. As noted above, the circumferentially disposed teeth 28 on the first circular drive gear 21 are engaged with the circumferentially disposed teeth 38 on the second circular drive gear 22. Thus, rotation of the first circular drive gear 21 will cause a corresponding rotation of the second circular drive gear 22 in the direction indicated by arrow A2 in FIG. 2. The eccentrically disposed drive pins 30 and 40 are engaged with the tongue lever 44 as explained above. Thus, rotation of the first circular drive gear 21 will cause the drive pin 30 thereof to move in the slot 50 of the tongue lever 44. This will generate an upward and downward movement of the tongue lever 44 and the tongue 46 attached thereto. The simultaneous rotation of the second circular gear 22 will cause both an upward and downward movement of the tongue lever 44 and an inward and outward movement of the tongue lever 44 relative to the head 11. The net effect of this pivoting movement will be a very realistic licking movement by the tongue 46. More particularly, the tongue 46 will be subject to both an inward and outward movement relative to the head 11 and an upward and downward orbital movement. The generally orbital movement of the tongue lever 14, including upward and downward components along with inward and outward components, causes the soft snout surrounding the tongue lever 44 to change shape. This changing of the shape of the snout is perceived as a facial movement and/or change of facial expression that occurs simultaneously with the licking movement.

Figure 3B:
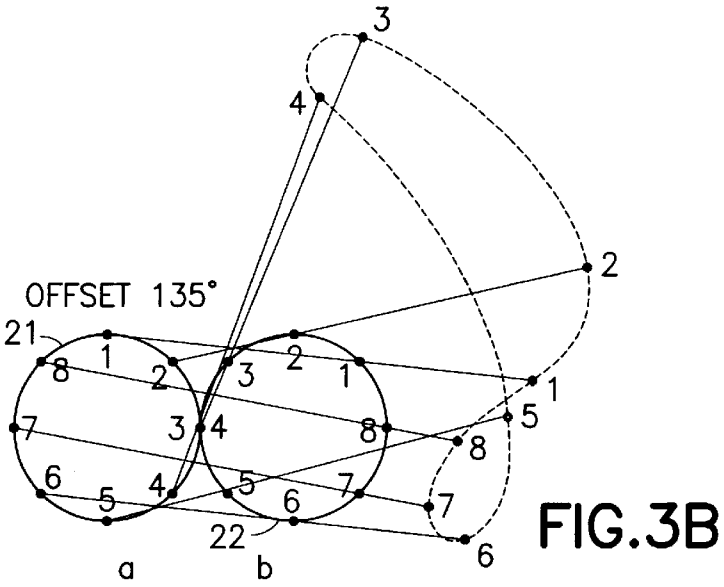
FIGS. 3A–3D show alternate embodiments with the relative orientations of the eccentric driving pins on the gears being differently disposed relative to one another.
Figure 3D:
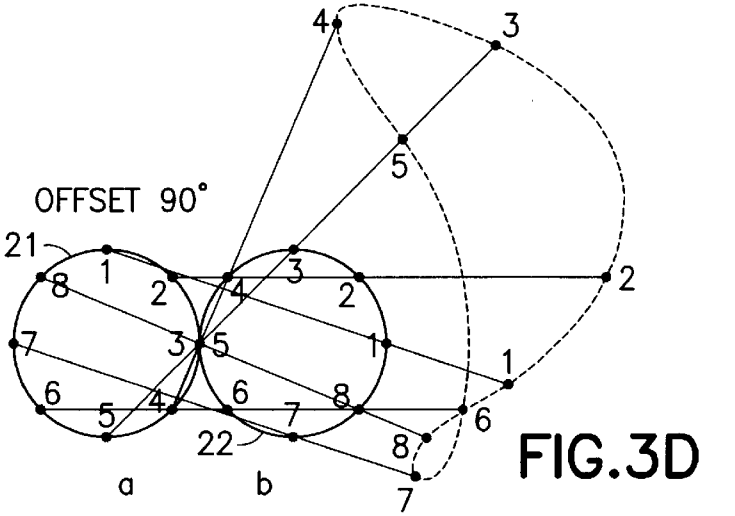
Figure 3A:
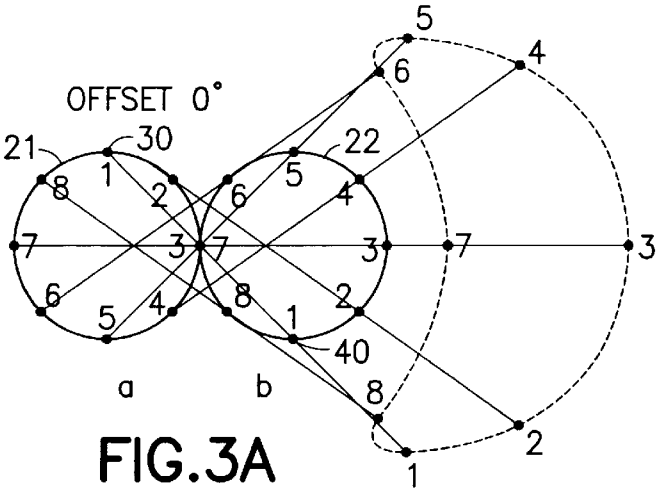
Figure 3C:
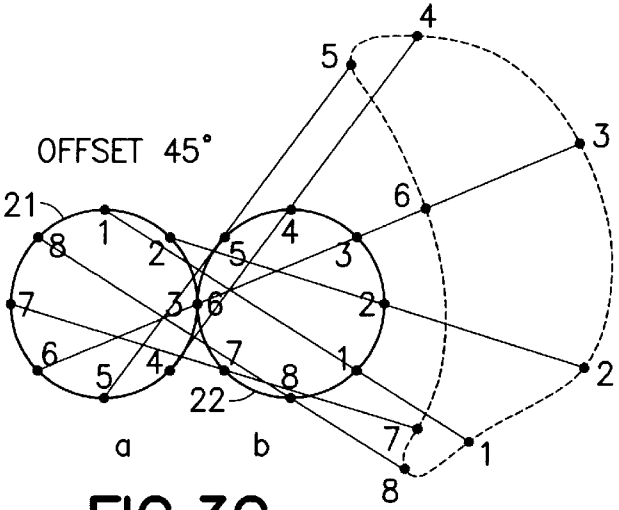

The licking pattern is dictated by the dimensions of the first and second drive gears 21 and 22 and by the relative positions of the eccentrically disposed drive pins 30 and 40. In particular, with reference to FIGS. 3A–3D, the pattern of movement of the tongue 46 can be selected by the relative positions of the eccentrically disposed drive pins 30 and 40. In this regard, FIG. 3A shows the first and second drive gears 21 and 22 oriented such that the eccentrically disposed drive pins are substantially in phase with one another (i.e., 0° offset). The pattern of licking movement is indicated by the respective broken lines in FIG. 3A. The portion of the licking pattern indicated by numerals 1–5 on the dotted line corresponds to the upward movement of the tongue, while the portion of the dotted line indicated by the numerals 6–8 represents a downward movement of the tongue. The upward movement of the tongue defines a larger arc, and therefore takes longer to complete. The downward movement of the tongue, however, represents a shorter arc, and therefore occurs more quickly. With reference to FIG. 3B, the pattern of movement can be changed significantly by moving the second circular drive gear 22 approximately 135° in a counter clockwise direction relative to the first circular drive gear 21. As shown in FIG. 3C, the pattern can be changed further by rotating the second circular drive gear 22 clockwise from the FIG. 3A orientation approximately 45°. FIG. 3D shows the effect of moving the second circular gear 22 approximately 90° in a counter clockwise direction from the FIG. 3A orientation. Although the respective licking patterns shown in FIGS. 3A–3D all are different, each represents a life-like licking pattern resembling the actual movement of the tongue of a dog or other toy animal. Additionally, each of these movements generates the realistic facial movements referred to above and due to the cooperation of the moving tongue lever and the soft snout. Variations in the licking pattern also can be achieved by employing differently dimensioned first and second drive gears 21 and 22.

Figure 4:
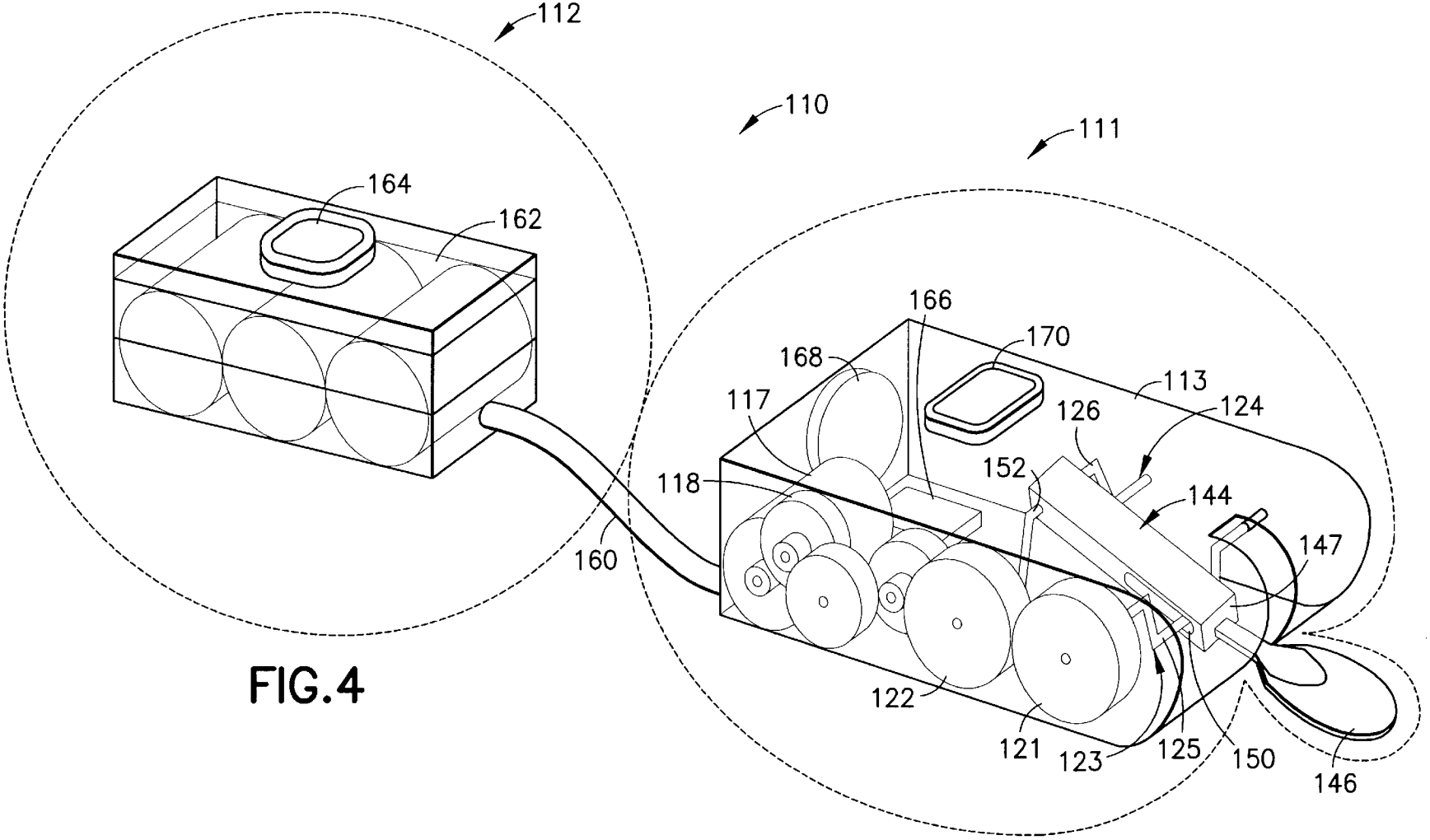
FIG. 4 is a schematic view of a second embodiment.

FIG. 4 schematically illustrates a second embodiment in which a toy dog 110 has a head 111 and a body 112. The head 111 includes a cavity 113 for accommodating movable parts of the toy 110. A motor 117 is mounted in the cavity 113. However, unlike the first embodiment, the motor 117 is aligned transversely in the head 111 and includes a circular main gear 118. It will be appreciated that this differs from the longitudinal alignment of the motor 16 in the embodiment of FIG. 2. Additionally, the circular main gear 118 shown in FIG. 4 differs from the worm gear 18 of FIG. 2. The operation, however, is very similar to the embodiments described above, including the optional phasings of the gears shown in FIGS. 3A–3D. More particularly, the circular main gear 118 extends through a plurality of intermediate gears to front and rear action spur or drive gears 121 and 122 respectively. The intermediate gears are provided to achieve a gear reduction so that the actual movement of the tongue is much slower than the rotation of the motor 117. The ratio of gear reduction will depend upon operating characteristics of the motor, sizes of the drive gears 121 and 122 and desired speed of the licking motion. The action spur or drive gears 121 and 122 each have offset beater arms 123 and 124 centrally mounted therein. The beater arms 123 and 124 are functionally similar to the eccentric drives described with respect to FIG. 2. The offset beater arms 123 and 124 include offset portions 125 and 126 respectively. The rear beater arm 124 has its offset portion 126 pivotally mounted in a through aperture 152 in the tongue lever 144. The front beater arm 123 has its offset portion 125 mounted in a longitudinally extending slot 150 in the tongue lever 144. The interior tongue support 146 is mounted at the front end 147 of the tongue lever 144 substantially as in the embodiment illustrated in FIG. 2 and described above.

A connecting wire 160 extends from the head 111 to the body 112 and into a battery housing 162. The switch 164 is operatively connected to the battery housing 162 and is at a location that is accessible from exterior portions from the body 112, such as the back of the toy 110. Thus, the switch 162 can be activated by petting the back of the toy 110. This activation will initiate rotation of the motor 117 and moving of the tongue as described in detail above. Additionally, the activation of the switch 164 will enable transmission of an electrical signal to a sound chip 166 for generating noise through a speaker 168. A second switch 170 also is schematically illustrated in the head 111. The second switch 170 may be activated by patting the head 111 of the toy 110. The connection of the switches 164 and 170 may generate identical responses from the toy 110. However, the switches could be connected to generate different responses. For example, one switch may be operative to generate only a licking action and associated facial movements, while another switch may be operative to generate both a barking and licking action along with associated facial movements.

While the invention has been described with respect to certain embodiments, it is apparent that various changes can be made without departing from the scope of the invention.

What is claimed is:

1. A toy animal having a body and a head on said body, an exterior material covering said body and said head, the exterior material on the head including a tongue exterior projecting from remaining portions of said head, a tongue assembly in said head and comprising a tongue lever having front and rear ends, an interior tongue support secured to said front end of said tongue lever and projecting into said tongue exterior, an electric motor in said head and a drive mechanism extending from said motor to said tongue lever for driving said interior tongue support through a selected licking motion along a first direction into and out of said head and along a second direction transverse to said first direction, said drive mechanism comprising a first gear rotatably driven by said motor and having an eccentric drive element pivotally connected to the rear end of the tongue lever and a second gear rotatably driven by said motor and having an eccentric drive element pivotally and slidably mounted to portions of said tongue lever between said front and rear ends.

2. The toy of claim 1, wherein portions of said head in proximity to said tongue exterior define a snout formed from a soft deformable material such that movement of said tongue assembly generates changes of shape of said snout for simulating facial movement of said toy animal, simultaneous with said licking motion.

3. The toy of claim 1, wherein the eccentric drive elements of said first and second gears comprise pins securely connected to said first and second drive gears at locations spaced radially from axes of rotation of said first and second gears.

4. The toy of claim 1, wherein the eccentric drive elements of said first and second gears comprise beater arms securely mounted to axes of rotation of said first and second gears for rotation therewith, said beater arms comprising offset portions spaced radially from said axes of rotation and engaged with said tongue lever.

5. The toy of claim 1, wherein said tongue lever includes a slot intermediate said front and rear ends thereof, said eccentric drive element of said second gear being pivotably and slidably engaged in said slot.

6. The toy of claim 1, wherein the interior tongue support is formed from a resiliently deflectable material.

7. The toy of claim 6, wherein the interior tongue support includes opposed front and rear ends, the rear end of said interior tongue support being folded around and secured to the front end of said tongue lever.

8. The toy of claim 7, wherein the tongue exterior is formed from a soft smooth material.

9. The toy of claim 1, wherein the eccentric drive element of the second gear is angularly offset relative to the eccentric drive element of the first gear, such that the eccentric drive elements are at different rotational phases relative to one another, said angular offset being chosen to achieve a selected licking pattern.

10. The toy of claim 1, wherein the first and second gears are differently dimensioned, said dimensions being selected to achieve a preferred licking pattern.

11. The toy of claim 1, wherein the motor drives the first gear, and wherein the first gear drives the second gear.

12. The toy of claim 1, wherein the motor drives the second gear and wherein the second gear drives the first gear.

13. The toy of claim 1, further comprising a switch accessible from an exterior location on said toy for actuating said motor and driving said tongue lever.

14. The toy of claim 13, further comprising an electrically powered noise generator connected to said switch for generating a noise when said switch is actuated.

15. The toy of claim 1, further comprising a power source in said body of said toy, said power source being electrically connected to said motor for selectively driving said motor, said toy further comprising a pressure sensitive switch substantially adjacent an external location on said toy, said switch being electrically connected to said power supply and to said motor, such that pressure at at least one location on said toy triggers said switch and actuates said motor.

16. The toy of claim 1, further comprising a plurality of intermedial gears disposed between said motor and said first and second gears, said intermediate gears being dimensioned and disposed to achieve a selected gear reduction such that said first and second gears rotate more slowly than said motor.

17. A toy animal having a body and a head secured to said body, a furry exterior material covering said body and at least portions of said head, a substantially hollow tongue exterior projecting from said head and communicating with interior portions of said toy animal, a portion of said head adjacent said tongue exterior being formed from a soft deformable material, a power supply accessibly disposed in said body, an electric motor disposed in said head and electrically connected to said power supply, a pressure sensitive switch disposed in proximity to said furry exterior material, said switch being connected to said power supply for selectively actuating said motor, a tongue assembly in said head and comprising a tongue lever having front and rear ends and an interior tongue support having front and rear ends and being formed from a resiliently deflectable material, said rear end of said interior tongue support being wrapped around opposed sides and securely connected to said front end of said tongue lever, said front end of said interior tongue support projecting into said tongue exterior, said tongue lever having an aperture in proximity to said rear end thereof and having an elongate slot between said front and rear ends thereof, a drive mechanism extending between said motor and said tongue lever, said drive mechanism comprising a first gear rotatable about a first axis and having a beater arm secured thereto for rotation with said gear, said beater arm having an offset portion spaced radially from said first axis and being pivotably connected to said aperture in said tongue lever, a second gear rotatable about a second axis and having a beater arm securely mounted to said second gear for rotation with said second gear about said second axis, said second beater arm having an offset portion slidably and rotatably engaged in said slot of said tongue lever, a selected one of said first and second gears being driven by said motor, and being driveably connected to the other of said first and second gears, whereby actuation of said switch powers said motor and drives said gears for moving said interior tongue support in said tongue exterior for simulating a licking action of the toy and for generating facial movements in said soft deformable portions of said head.

* * * * *